United States Patent [19]

Rundberg, Jr. et al.

[11] 4,002,179

[45] Jan. 11, 1977

[54] SMOKING COMPOSITIONS INCORPORATING A MENTHOL-RELEASE AGENT

[75] Inventors: Eric G. S. Rundberg, Jr.; William R. Johnson, Jr.; Harvey J. Grubbs, all of Richmond, Va.

[73] Assignee: Philip Morris Incorporated, New York, N.Y.

[22] Filed: Mar. 18, 1975

[21] Appl. No.: 559,574

Related U.S. Application Data

[62] Division of Ser. No. 384,048, July 30, 1973, Pat. No. 3,887,603.

[52] U.S. Cl. ..... 131/17 A
[51] Int. Cl.[2] ..... A24B 3/14
[58] Field of Search ..... 131/17 R, 140–144, 131/17 A

[56] References Cited

UNITED STATES PATENTS 3,419,543 12/1968 Mold et al. ..... 260/234

*Primary Examiner*—Robert W. Michell
*Assistant Examiner*—V. Millin

[57] ABSTRACT

This invention relates to novel oligomers and polymers produced from monomer carbonate esters of menthol having the formula:

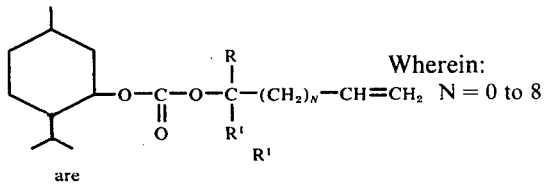

are

R and $R^1$ are independently selected from the group consisting of aliphatic, alicyclic and aromatic hydrocarbons These compounds find particular use as menthol-release agents which will impart improved aroma, flavor, and taste effects to natural and reconstituted smoking products.

10 Claims, No Drawings

SMOKING COMPOSITIONS INCORPORATING A MENTHOL-RELEASE AGENT

This is a division of application Ser. No. 384,048, filed July 30, 1973, now U.S. Pat. No. 3,887,603.

BACKGROUND OF THE INVENTION

Numerous methods for adding flavorants to tobacco smoke are known in the art. None of these methods, however, has proven completely satisfactory, particularly where the desired flavorant is menthol.

The addition of menthol per se to tobacco has been found to be ineffective. The highly volatile nature of this compound results in a relatively high loss factor incident to the storage and manufacturing stages required for the production of a smoking product. Quite clearly, such loss is undesirable from an economic standpoint.

In an attempt to alleviate these problems, it has been suggested that menthol might be adsorbed on a suitable support, such as activated charcoal or fuller's earth, and that the resultant composition might then be added to the tobacco. Attempts to pursue this method have not, however, met with complete success. The menthol yields from such adsorbants have been found to be very low. Moreover, this method obviously necessitates incorporation of the adsorbant into the tobacco, and such a foreign material may result in an undesirable appearance as well as give rise to uneven burning of the tobacco.

In order to overcome these difficulties, it has been suggested that the menthol could be incorporated into the tobacco as a part of a compound — i.e. a menthol release agent — in such form that upon burning of the tobacco, the compound would be decomposed to yield the desired menthol flavorant. While considerably more satisfactory than earlier attempts, even this technique has evidenced certain drawbacks.

Bavley et al, U.S. Pat. No. 3,312,226, describes a process whereby menthol is incorporated into tobacco as the carbonate ester of various alcohols, particularly one such as linalool, which were themselves useful flavorants. Upon pyrolysis of these carbonate esters, incident to the normal burning temperatures of the tobacco, the menthol is released to flavor the smoke.

Unfortunately, these simple carbonate esters have not proven wholly satisfactory. They retain one of the difficulties of menthol itself, in that they are somewhat susceptible to migration in the tobacco, and thereby prevent the strict control of quantitative release of menthol to the tobacco smoke during burning. Additionally, the second alcohol of the carbonate ester can prove susceptible to chemical alteration during pyrolysis, thus giving rise to undesirable chemical fragments which may add a chemical aftertaste to the smoke.

The Mold et al U.S. Pat. Nos. 3,332,428 and 3,419,543, offer a slightly different approach to the problem of adding menthol flavor to a tobacco smoke. These patents, like that of Bavley et al, rely upon the formation of a carbonate ester to bind the menthol in a release agent. Here, however, a polyhydroxy compound such as a monosaccharide, disaccharide, trisaccharide, polysaccharide, or glycol is used to fix the menthol in the tobacco. Again there are certain drawbacks.

Because the alcohol linkages of these saccharides and glycols are only primary or secondary in character, the efficiency with which the menthol can be regenerated upon pyrolysis is limited, owing to the opportunity for dehydration of the menthol moiety. Additionally, where attempts were made to utilize menthol-release agents of high menthol proportion — i.e., agents which would release a high proportion of menthol per unit weight — it was discovered that menthenes were often produced in addition to menthol elimination, thereby resulting in a bitter tasting tobacco smoke.

THE INVENTION

It is the object of this invention to permit the incorporation into tobacco of a compound which will release menthol to the tobacco smoke.

It is a further object of the present invention to utilize a menthol-release compound characterized by a substantial lack of volatility and/or mobility at ambient temperatures within a tobacco composition. Such properties insure the uniformity of the flavor of tobacco smoke both within each individual tobacco product and from product to product.

It is a further object of the present invention to insure that any non-menthol residue resultant from the pyrolysis, incident to normal smoking, of a composition containing a menthol-release agent will be non-deleterious to the flavor of the resultant tobacco smoke.

It is a still further object of the present invention to provide a menthol-release agent for tobacco smoking compositions, characterized by an optimal efficiency of release of menthol, incident to normal smoking of the compositions. In this manner, the amounts of such additive required to be added to a tobacco composition may be minimized.

The objects of the present invention have been satisfied by the discovery of oligomers and lower molecular weight polymers which are characterized by repeating units of the formula:

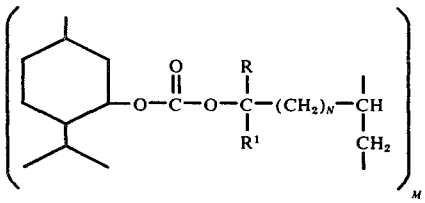

Wherein:
N= 0 to 8
M= 2 to 100

-and-
R and $R^1$ for each unit are selected from the group consisting of aliphatic, alicyclic and aromatic hydrocarbons (A)

A preferred class of additive of this invention which maximizes the weight percent of menthol available for release includes those oligomers and lower molecular weight polymers which are prepared solely from monomers or mixtures of monomers selected from the 1-menthyl 1,1-dimethyl-alkenyl carbonates as are more fully described below.

The present oligomers and polymers cannot here be precisely identified individually - in view of their occurrence as mixtures; possible minor rearrangements in the units incident to polymerization; and other variables with which those of ordinary skill in the art are familiar. Based upon some experience and testing, however, it is believed that the additives of this invention may be characterized by the following molecular formula:

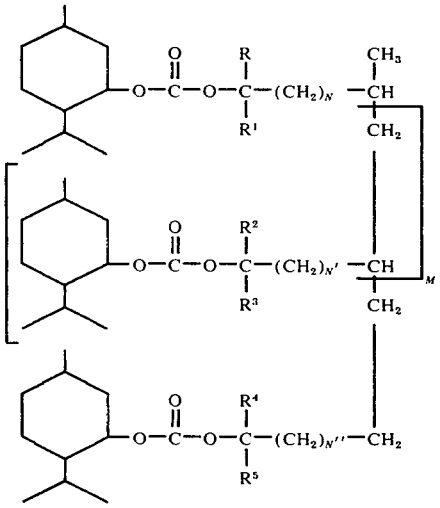

Wherein:
N = 0 to 8
N' = 0 to 8
N'' = 0 to 8
M = 0 to 98

-and- (A')

The N' value of each of the M separate internal units is independently variable within the values, 0 to 8.

-and-

R, $R^1$, $R^4$, $R^5$ and each $R^2$ and $R^3$ is selected from the group consisting of aliphatic, alicyclic and aromatic hydrocarbons.

The addition of from about 1.0 to about 10.0 weight percent of members of the above-indicated classes of polymers to a natural or reconstituted tobacco smoking product will result, through the pyrolysis of the polymers under smoking conditions, in the addition of an appropriate amount of menthol to the tobacco smoke to meet the subjective demands of educated consumers. Such flavoration of the tobacco smoke results in modifications of taste and flavor, so as to result in a gentle cooling effect on the mouth and throat and in a spice-like cooling and taste effect which will linger on after each puff.

It is believed that the instant production of menthol during smoking takes place in accordance with a simple pyrolysis reaction; the byproducts of which consist essentially of only carbon dioxide and an ordinary, nongaseous hydrocarbon. Accordingly, only the menthol itself is consequential with respect to flavoring the tobacco smoke, and one of the major drawbacks of the prior art additives thereby is avoided.

It has additionally been discovered that incident to the present use of a tertiary alcohol ester attachment of the menthyl carbonates to the hydrocarbon backbone in the present polymeric menthol-release agent, the efficiency of menthol release is improved. The present mode of attachment of the menthyl radical renders de-esterification the greatly preferred decomposition mechanism under ordinary smoking conditions. Accordingly, this invention offers not only a method whereby substantially all the incorporated menthol may be released to the tobacco smoke, but further does so in such manner as to result almost exclusively in the desired menthol product.

In addition to the aforementioned ease and selectivity of production of menthol, the instant oligomers and low molecular weight polymers are further characterized by their substantial lack of volatility and/or mobility within tobacco at temperatures beneath those encountered upon combustion of the smoking composition. Accordingly, the use of the present polymeric menthol-release agents avoids the pitfalls encountered in the processing and storage of tobacco products containing prior art flavoring agents.

In accordance with this invention, there are substantially no losses of menthol through sublimation or volatilization thereof during the manufacturing and storage operations incident to the production of a useful smoking composition. Additionally, the drawbacks of diffusion of menthol, or of a menthol-release agent, within the tobacco are successfully eliminated, and the control of quality and uniformity within the product tobacco compositions is successfully maintained.

The present polymeric menthol release agent may be produced from monomers having the formula:

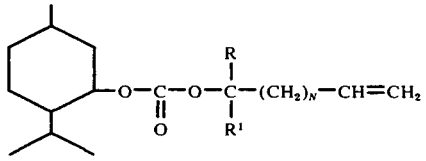

(B)

Such compounds, per se, also constitute an important part of the present invention, although their production may be accomplished by means within the skill in the art, see for example Bavley et al, U.S. Pat. No. 3,312,226.

In the foregoing formula, the values represented by N, R, and $R^1$ may be varied considerably without substantial adverse effect on the utility of the present monomers or of their product menthol release agents. Thus, for example, N — which merely reflects the linear separation between the menthol releasing radical and the eventual polymeric backbone of the release agent — should usually be maintained within the limits of from 0 to about 8 carbons in length, although most preferably this value resides between 0 and 2.

The side chains of the present monomers (R and $R^1$) and of the eventual polymeric release agent (R and $R^1$, or R, $R^1$, $R^2$, $R^3$ . . . etc. where mixtures of monomers are polymerized) may also be varied within wide limits without detrimental effect. As has been noted previously, each of these side chains must minimally comprise at least one carbon, in order to satisfy the discovered requirement that the carbon to which each pair is commonly attached in each monomer be tertiary. The maximum size of the hydrocarbon side chains, on the other hand, is limited essentially through the steric effects of their presence in each monomer. They may therefore be selected in accordance with parameters well known in the prior art. Preferably, however, each such side chain should not exceed about 10 carbons in number.

Representative of the side chains which have been discovered to be useful in the present invention are the aliphatic, alicyclic and aromatic hydrocarbons. The most preferred of the aliphatic radicals are chains of 1 to 6 carbons in length, which may comprise either normal or branched aliphatics such as the methyl, ethyl, propyl and isopropyl moieties. Preferred alicyclics contain from about 5 to 10 carbons and include the cyclohexyl moiety and lower (e.g. methyl and ethyl) homologs thereof. The most preferred of the aromatic side chains of this invention contain from 6 to 10 carbons and are exemplified by the phenyl, benzyl, tolyl and lower (e.g. phenyl ethyl and phenyl propyl) homologs thereof.

In order to avoid interference or complications during the polymerization of the present invention, the side chains should preferably be restricted to groups which will not enter into the reaction. Accordingly, it is desirable that the side chains comprise only saturated or aromatic constituents.

Preferentially, the synthesis of monomers and polymers within the scope of the instant invention is performed in accordance with the following sequence of equations:

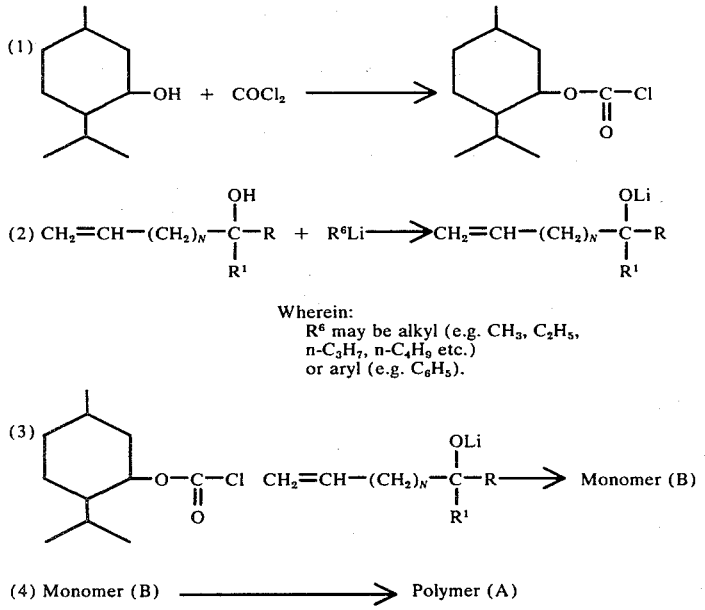

Equation 1 illustrates the preparation of a halocarbonate which can be employed in accordance with the present invention. The reaction may, for example, be carried out at a temperature of from about 5° to about 35° C in a common solvent for the menthol and carbonyl chloride — e.g. benzene. The carbonyl chloride is preferably added in substantial molar excess of the menthol, and an appropriate catalyst — e.g. pyridine — may be employed in such an amount as to facilitate the reaction. The reaction mass should be stirred for a total of about 3 hours and then allowed to stand overnight. At the end of this time, 1-menthyl chloroformate may be recovered as a slightly yellow liquid.

Equation No. 2 merely illustrates the activation of the unsaturated tertiary alcohol which will eventually constitute the backbone of the present polymeric menthol-release agent. The production of the metal alkoxide may best be accomplished through the addition, at ice temperatures and under an inert atmosphere, of approximately 1:1 proportions of a lower alkyl lithium compound to an appropriate, unsaturated tertiary alcohol. After a few minutes, the reaction mixture may be brought to room temperature and the metal alkoxide, if desired, isolated.

Equation No. 3 illustrates the preparation of the 1-menthyl 1,1-substituted alkenyl carbonate monomers of the present invention. This synthesis may be accomplished through the addition of the 1-menthyl chloroformate produced in accordance with Equation 1 to a solution of the metal alkoxide product of Equation 2. Both ingredients should be in appropriate solvents, for example anhydrous tetrahydrofuran, and the addition should be performed at close to ice temperature. The resultant admixture should then be heated at reflux temperatures (60° to 80° C) for from 10 to 20 hours, cooled to ice temperature, and then slowly hydrolyzed with water. Separation of layers is followed by extraction of the aqueous layer with anhydrous ether. Washing of the combined organic layers, followed by drying and solvent evaporation will yield the desired product as a liquid residue.

The vinyl unsaturation of the present monomers permits homopolymerization in the presence of conventional initiators of vinyl polymerization — e.g. peroxides (preferably benzoyl peroxide) azo compounds and the like — in accordance with the reaction set forth in Equation 4. The reaction of this equation may be performed at ambient temperature, but preferably from 50° to 90° C, under an inert atmosphere. After from 20 to 100 hours, the reaction mass may be dissolved in an appropriate solvent, washed and separated.

The present polymeric, menthol-release agents may vary greatly in molecular weight. Thus, for example, the number of monomeric units may range from 2 to 100 yielding molecular weights of from about 550 to 30,000. All such polymers are useful within the scope of this invention, however, it is preferred that polymerization be controlled — through modification of the catalyst concentration, temperature, time of reaction, etc. — in order to obtain reaction products having from about 6 to about 40 monomeric units or molecular weights of from about 1600 to about 12,000.

The product, polymeric menthol-release agent, may be incorporated into the tobacco in accordance with any of the methods customary in the art. Thus, it is possible merely to mix the polymer with the free tobacco prior to the manufacture of the product smoking composition.

Preferably, however, the polymer will be dissolved in an appropriate solvent such as acetone and then sprayed or injected into free tobacco. Such method insures a proper distribution of the polymer throughout the tobacco itself, and thereby permits the production of a more uniform smoking composition.

In the foregoing discussion, it is understood that in the various formulae the figure,

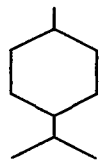

has been employed to represent the 2-isopropyl - 5-methyl cyclohexyl radical. Additionally an unsatisfied valence in a formula — such as polymer (A) — merely indicates the position for similar attachment to another monomer or to a chain terminator such as a methyl radical.

Specific examples of the preparation of the present monomers and polymers, as well as of their use in a smoking product, are as follows:

EXAMPLE 1

Preparation of the Monomer

A solution of 2-methylbut-3-en-2-ol (0.2 mole, 17.2g) in anhydrous tetrahydrofuran (THF, 300 ml) was degassed with nitrogen and cooled to ice temperature. n-Butyllithium (0.23 mole, 2.38M, 100 ml in hexane) was added to the ice-cold stirred solution during 8 minutes and a slow evolution of butane was observed. The reaction mixture was stirred at room temperature (27° C) for 2 hours (gas evolution stopped by this time). After cooling the mixture to ice temperature 1-menthyl chloroformate (43.8g, 0.2 mole) in anhydrous THF (150 ml) was added over a 14-minute period. The solution changed from a yellow to an orange-red color. The solution was heated at reflux temperature (65° C) for 1.5 hours, cooled to ice temperature and slowly hydrolyzed with water (400 ml). The aqueous layer was washed with two volumes each of 75 ml and then 100 ml of anhydrous ether. The combined organic layers were dried over anhydrous $Na_2SO_4$ for 16 hours. After filtration and solvent evaporation, an orange-red liquid residue was obtained. A number of gas chromatographs were taken of the residue and a peak (menthol) increased as the injection port temperature gas was increased. The residue was fractionally distilled through a spinning-band column and 4 fractions were obtained. An IR spectrum was taken of each fraction. (See below.)

| Fraction | Wt. | bp | (mm) | | IR |
|---|---|---|---|---|---|
| 1 | 1.60g | 27–80° C | (0.5–0.9) | strong | OH, wk. C=O |
| 2 | 3.48 | 80–82 | (0.95–1.0) | no | OH, strong C=O |
| 3 | 19.47 | 94 | (0.55) | no. | OH, strong C=O |
| 4 | 1.82 | 90–80 | (0.7) | no | OH, strong C=O |

Samples of fractions 2, 3, and 4 were submitted for NMR analyses.

Data from NMR indicated that fraction 3 was the desired 1-menthyl 1,1-dimethylallyl carbonate.

Yield 19.47g $$\% \text{ Yield} = \frac{19.47}{53.6}(100) = 36.3\%$$

Elemental Analysis:
Found: C, 71.67; H, 10.71
Calc: C, 71.60; H, 10.52

EXAMPLE 2

Polymerization

Benzoyl peroxide (BPO, 0.5g) was placed in a 100 ml round bottom flask which was purged with nitrogen for 15 minutes. 1-menthyl 1,1-dimethylallyl carbonate (11.05g) was added via a syringe to the BPO while the system was flushed with nitrogen. The stoppered suspension (light yellow) was placed in an oven at 75° ± 2° C. The mixture was swirled at 30 minute intervals for 1.5 hours, and the BPO dissolved within 1 hour. After the mixture had been in the oven for 65 hours, it was cooled to room temperature. The reaction mixture was a pale yellow gelatinous mass.

The gel was dissolved in methylene chloride (2 × 50 ml) and washed into a 1 liter Erlenmeyer flask. After adding 99% isopropyl alcohol (300 ml), methyl alcohol (450 ml) was added with vigorous stirring. A fine white precipitate formed, and after 30 minutes, it was filtered and dried.

Yield 5.52g $$\% \text{ Yield} = \frac{5.52}{11.05}(100) = 50\%$$

A small sample was heated and emitted a strong menthol-like odor.

Elemental Analysis: Found: C, 71.60; H, 10.54; O, 18.04. Calc.: C, 71.60; H, 10.52; O, 17.88.

Molecular weight determination by the ebulliometric method in dichloromethane gave a value of approximately 2500 (i.e. M = 9). Polymers prepared with slight variations in procedure, such as increased catalyst concentration, showed values of about 5000 (M = 18) and 7500 (M = 25).

EXAMPLE 3

Polymer as Tobacco Flavorant

Reconstituted tobacco was prepared as handsheets by a conventional method, with 6.0 percent by weight of the powdered polymer product of Example 2 incorporated in it at the slurry stage. There was no odor of menthol observed during casting, drying, or shredding of the sheets.

The shredded product was mixed with an equal portion of cased commercial filler containing no menthol. Cigarets 85 mm long with 20 mm commercial cellulose acetate filters were prepared from this mixture by use of a manual cigaret maker. The total weight of filler per cigaret was 900 mg, containing 27 mg (3.0%) of the polymer.

The cigarets were smoked according to the standard FTC method and menthol was found to be present in the mainstream smoke. The puff count was 12.1 and a total 0.59 mg of menthol was measured. The theoretically available menthol was 58% of the polymer weight, or 15.7 mg; the amount found in mainstream smoke was 3.8% of this. Similar cigarets were packaged and stored under the various conditions indicated below. Changes in menthol delivery upon smoking were regarded as not significant.

| Storage Period | Conditions | Mainstream Menthol, mg/cigaret |
|---|---|---|
| 7 days | Ambient humidity, room temperature | 0.45 |
| 1 month | Ambient humidity, room temperature | 0.53 |
| 1 month | 15% Relative humidity, 110° F. | 0.59 |
| 1 month | 85% Relative humidity, 90° F. | 0.50 |

Cigarets prepared in accordance with the example were also smoked by a panel of expert smokers who found acceptable to excessive menthol cooling with no off notes.

EXAMPLE 4

Preparation of 1-Menthyl 1,1-Dimethylundec-10-enyl Carbonate

A solution of 2-methyldodec-11-en-2-ol (39.70g, 0.20 mole) in anhydrous THF (300 ml) was cooled to ice temperature and nitrogen was passed through the system for 20 minutes. n-Butyl lithium (2.1 M in hexane, 120 ml, 0.24 mole) was added via a syringe to the cold, stirred solution over a period of 10 minutes. An evolution of butane was noted during the addition. The lemon yellow solution was then stirred at room temperature for 2 hours. Because the gas evolution had not ceased, the solution was warmed to about 35° C and held there for 45 minutes. After the solution had been cooled to ice temperature, 1-menthyl chloroformate (45.9g, 0.21 mole) in anhydrous THF (150 ml) was added over a 9-minute period. The color of the reaction mixture went from lemon-yellow to wine-red. The reaction mixture was heated at reflux temperature for 2 hours, was cooled to ice temperature, and was then hydrolyzed with 700 ml water. The aqueous layer was extracted with 4 × 100 ml anhydrous ether. The combined organic layers were filtered and then dried for 16 hours over anhydrous $Na_2SO_4$. After filtration, the solvents (ether and THF) were stripped from the reaction product with the aid of a rotary evaporator. The residue was a deep red, oily liquid. It was distilled under reduced pressure through a six-inch Vigreux column and four fractions were taken; IR and NMR spectra indicated that the product was concentrated in fractions 3 and 4, particularly the latter, and probably in the residue. (see below)

| | Fraction Weight | bp | (mm) | IR | NMR |
|---|---|---|---|---|---|
| 1 | 3.48g | 28–85° C | (0.2–0.3) | strong OH, no C=O | |
| 2 | 14.85 | 77–87° | (0.2–0.35) | strong OH, no C=O | |
| 3 | 4.3 | 87–100° | (1) | OH and C=O | Estim. 50% menthol |
| 4 | 32.35 | 103–117° | (1) | OH and C=O | Estim. 35% menthol |
| Residue | | | | | Carbonate, no menthol |

EXAMPLE 5

Preparation of 1-Menthyl 1-Benzyl-1-methylbut-3-enyl Carbonate N:1 R:$CH_3$ R':benzyl The method of Grignard and Chambret, Compt. rend. 182, 299(1926) was used to prepare 2-benzylpent-4-en-2-ol. The alcohol was converted to the 1-menthyl carbonate by a procedure like that of Example 4. Distillation of the extracted product through an 8-inch Vigreux column gave fractions boiling 25°–110°/0.04–0.6 mm, all having strong OH absorption in the infra-red. The residue was distilled through a short path and the fraction boiling 165°–6°/0.6–0.7 mm showed the following IR absorptions: no OH, strong carbonate (1750 and 1255 $cm^{-1}$), vinyl (1655, 978, 913 $cm^{-1}$), monosubstituted aromatic (750 shoulder, 697 $cm^{-1}$). NMR analysis indicated 80% of the expected mixed ester, a yield of 18.0% from the alcohol. This product had very little odor, but on heating produced a menthol odor.

EXAMPLE 6

Preparation of 1-Menthyl 1-Ethyl-1-methylpent-4-enyl Carbonate N:2 R:ethyl R':methyl

Alcohol

The Grignard reaction was employed to prepare 3-methylhept-6-en-3-ol from 5-hexen-2-one and ethyl bromide by a conventional procedure. The distilled product showed a yield of 77% and possessed a boiling point in the range 67°–80° C at 20 mm which is the bp and pressure given by Cologne and Clerc, Bull. soc. chim. France, 1955, 836 for this compound. IR and NMR data showed a pure product.

Carbonate

To prepare 1-menthyl 1-ethyl-1-methylpent-4-enyl carbonate, a solution of the alcohol (17.6g, 0.137 mole) in anhydrous tetrahydrofuran (THF, 100 ml) was flushed with nitrogen for 10 minutes and cooled to ice temperature. n-Butyllithium in hexane (0.12 mole, 54 ml of 2.34 M soln.) was added by syringe in 2.5 minutes; there was gas evolution. The mixture was stirred at room temperature for 1.5 hours and recooled to ice temperature. A solution of 1-menthyl chloroformate (21.0g, 0.10 mole) in 75 ml anhydrous THF was added in six minutes. The pale yellow solution was heated at reflux for two hours and then recooled to ice temperature. The solution was carefully hydrolyzed with 300 ml of water, the layers were separated, and the aqueous layer was washed with 3 × 75 ml of ether. The combined ether and organic layers were dried over anhydrous $Na_2SO_4$ for 17 hours. Filtration and concentration gave a liquid residue (35g) which was distilled under reduced pressure through an eight-inch Vigreux column; fraction appeared to be menthol and had to be removed from the cold finger where it condensed as crystals.

| | Fraction Weight | bp° C | (mm) | IR | NMR |
|---|---|---|---|---|---|
| 1 | 6.81g | 24–6° | (0.03) | strong OH, med. C=C, C=O | |
| 2 | 1.2 | 26–91 | (0.03) | (white solid) | |
| 3 | 17.44 | 92–4 | (0.04) | strong C=O, C=C, O—C(=O)—O, no OH | carbonate high purity |

Fraction 3 was clear, colorless liquid with a faint non-menthol odor; heating caused liberation of a menthol-like odor. Yield of the mixed carbonate was 56.2%.

EXAMPLE 7

Preparation of 1-Menthyl 1-Isopropyl-1-phenylbut-3enyl Carbonate N:1 R:phenyl R′:isopropyl

2-Methyl-3-phenylhex-5-en-3-ol

Allylmagnesium bromide was prepared by conventional means from allyl bromide (90.75g, 0.75 mole) and the ether solution cooled to ice temperature. Isobutyrophenone (74.1g, 0.5 mole) in 200 ml anhydrous ether was added at a rate to maintain gentle reflux, over a period of 100 minutes. The mixture was heated to reflux for about 50 minutes and left at room temperature overnight. It was poured over 500g of ice and a white precipitate formed. This was dissolved by adding 500 ml of 10% HCl and the separated aqueous layer was extracted with 4 × 74 ml of ether. The combined organic layers were washed with 3 × 125 ml of 5% sodium bicarbonate and 5 × 100 ml of water and dried over anhydrous $Na_2SO_4$ four hours. Filtration and concentration gave 84g of liquid which was then distilled through an eight-inch Vigreux column under reduced pressure.

| | Fraction Weight | bp° C (mm) | IR |
|---|---|---|---|
| 1 | 4.25g | 92.5–105(5) | med. OH, med. C=O |
| 2 | 11.18 | 96–105.5(5) | med. OH, weaker C=O |
| 3 | 3.27 | 100–107(5) | med. OH, less C=O |
| 4 | 8.91 | 106–112(5) | med. OH, trace C=O |
| 5 | 42.25 | 112–118(5–6) | strong OH, no C=O |

The yield (fraction 5) was 44.4%; NMR analysis confirmed it to be the pure alcohol.

Carbonate

A solution of the alcohol (19.0g, 0.10 mole) in 100 ml of anhydrous THF, flushed with nitrogen, was cooled to ice temperature; n-butyllithium (0.12 mole, 54 ml of 2.34 M in hexane) was added by syringe in six minutes; and gas evolution from the orange mixture was noted. It was stirred 1.5 hours at room temperature and recooled. A solution of 1-menthyl chloroformate (21.9g, 0.1 mole) in 75 ml of anhydrous THF was added in 6½ minutes, followed by 75 ml more THF to maintain fluidity. The suspension was heated at reflux for two hours and became an orange-red solution. It was cooled to ice temperature and hydrolyzed with 300 ml of water added slowly. The aqueous layer was extracted with 4 × 75 ml of ether and the combined organic layers dried 17 hours over anhydrous $Na_2SO_4$. Filtering and concentrating gave 37g of liquid product. This was distilled through an eight-inch Vigreux column; the distillate (bp 24°–92° C at 0.08 to 3mm) had menthol odor and no C=O or $$\overset{O}{\overset{\|}{OCO}}$$

absorption in IR. The pot residue was a viscous oil having no menthol odor (except when heated), weak OH and strong C=O, $$\overset{O}{\overset{\|}{OCO}},$$

and CH=$CH_2$ absorption in IR, as well as for monosubstituted aromatic. An estimation of 1-menthyl 1-isopropyl-1-phenylbut-3-enyl carbonate content of this residue was 70% by NMR, or 50% yield for 26.7g weight.

EXAMPLE 8

Preparation of 1-Menthyl 1-Methyl-1-phenylbut-3-enyl Carbonate N:1 R:$CH_3$ R′:phenyl 2-Phenylpent-4-en-2-ol was prepared by the procedure of Helferich and Lecher, Ber. 34B, 930(1921); see also German Patent 544,388 (1930), C.A. 26, 2466[9] (1932). Literature gives bp 91°–2° C/3 mm and the fraction used here had bp 98°–9°/10 mm. The IR showed a weak to trace C=O and strong OH.

A solution of this alcohol (16.22g, 0.01 mole) in 150 ml of anhydrous THF was degassed with nitrogen and cooled to ice temperature. n-Butyllithium (0.12 mole, 53 ml of 2.38 M in hexane) was added by syringe to the stirred solution in 6 minutes. A slow evolution of butane was noted. The lemon yellow solution was stirred at room temperature for 1.5 hours and recooled to ice temperature. 75 ml of anhydrous THF containing 1-menthyl chloroformate (21.9g, 0.01 mole) was then added over 10 minutes. The orange mixture was heated at reflux for two hours and recooled to ice temperature. It was carefully hydrolyzed with 400 ml of water; the aqueous layer was extracted with 4 × 70 ml of ether and the combined organic layers were dried over anhydrous $Na_2SO_4$ 16 hours. Filtering and concentrating gave 34g of orange-red oil. This was distilled through an eight-inch Vigreux column under reduced pressure, and IR spectra were obtained for the fractions.

| | Fraction Weight | bp° C (mm) | IR |
|---|---|---|---|
| 1 | 4.42g | 24–47 (0.07) | Strong OH, weak C=O |
| 2 | 5.01 | 52–81 (0.08–0.11) | Strong OH, med. C=O, $\overset{O}{\overset{\|}{OCO}}$ |
| 3 | 4.11 | 82–99 (0.7) | Med. OH, med. C=O, |

-continued

| | Fraction Weight | bp° C (mm) | IR |
|---|---|---|---|
| 4 | 5.0 | 99–104 (1.0) | Weak OH, strong C=O, OCO |
| 5 | 4.57 | 104–120 (1.0) | Weak OH, C=O, OCO |

Fraction 4 subjected to NMR analysis showed a 45 to 50% content of the mixed menthyl methylphenylbutenyl carbonate. Its odor was light and pleasant but non-menthol-like. On heating it gave a menthol odor.

EXAMPLE 9

Preparation of 1-Menthyl 1,1-Diphenylbut-3-enyl Carbonate N:1 R,R':phenyl

The method of Kharasch and Weinhouse, J. Org. Chem. 1, 209(1936) was used to prepare 1,1-diphenylbut-3-en-1-ol. The product boiled at 124° C/0.05 mm, while the literature teaches 150°–55°/3 mm.

This alcohol (22.4g, 0.10 mole) in 100 ml anhydrous THF was flushed with nitrogen and cooled to ice temperature n-Butyllithium (0.12 mole, 54 ml of 2.34 M soln. in hexane) was added by syringe in five minutes. There was gas evolution and the mixture became blood red. It was stirred at room temperature for 1.5 hours and recooled. A solution of 1-menthyl chloroformate (21.9g, 0.10 mole) in 75 ml of anhydrous THF was added in 10 minutes. The reaction mixture, now light orange, was heated at reflux for two hours and then cooled to ice temperature.

The mixture was carefully hydrolyzed with 300 ml of water. The aqueous layer was extracted with 4 × 75 ml of ether and the combined organic layers were dried over anhydrous $Na_2SO_4$ for 16 hours. Filtration and concentration give 38g of a viscous, odorless oil. Attempted distillation gave a product with menthol odor and strong OH absorbance in the IR, indicating decomposition. The undistilled liquid showed IR evidence for carbonate, aromatic ring, monosubstituted aromatic ring, vinyl, and plural methyl groups. NMR analysis indicated about 70% content of the expected carbonate.

EXAMPLE 10

Preparation of 1-Menthyl 1,1-Dimethylpent-4-enyl Carbonate N:2 R,R':$CH_3$

A solution of 2-methylhex-5-en-2-ol (22.8g, 0.2 mole) in 400 ml of anhydrous THF was cooled to ice temperature and purged with nitrogen; n-butyllithium (100 ml of 2.38 M in hexane) was added to the stirred solution by syringe in 10 minutes. It was stirred at room temperature for 1.5 hours, by which time the evolution of butane had ceased. A solution of 43.8g, 0.2 mole of 1-menthyl chloroformate in 150 ml anhydrous THF was added at ice temperature during 11.5 minutes. After 2 hours at reflux, the solution became deep orange-red. Hydrolysis and isolation of product followed the general procedures of earlier examples.

Distillation at reduced pressure through a short-path semimicro apparatus gave 26.7g of product boiling point 98°–106° C/0.17–0.26 mm having no menthol odor. Redistillation gave a forerun of 0.8g and 23.3g of product boiling point 92°–4°/0.12 mm, or 39.2% yield. NMR analysis indicated no hydroxyl. IR spectrum showed peaks at 1745 and 1270 $cm^{-1}$ (carbonate), 1390 and 1375 $cm^{-1}$ (gem dimethyl) and 3090, 1650, 985, and 912 $cm^{-1}$ (vinyl). Analysis:

| | Calc. | found |
|---|---|---|
| % C | 72.93 | 72.98 |
| % H | 10.88 | 10.43 |

EXAMPLE 11

Polymerization

The carbonate produced in Example 4, 1-menthyl 1,1-dimethylundec-10-enyl carbonate, after further distillation at 0.5 mm pressure (weight 2.0g) was mixed with 0.2g of benzoyl peroxide and treated according to the procedure of Example 2. Heating time was 96 hours. A colorless, viscous oil was obtained. When 50 ml of methanol was added and the mixture was triturated, a white oily mass settled out. A sample of this mass was subjected to IR analysis; peaks characteristic of carbonate were present at 1740 and 1260 $cm^{-1}$, while peaks characteristic of unsaturation at 1640, 1000, and 910 $cm^{-1}$ were greatly diminished in comparison with the monomer. After 5 washings with methanol the oily mass became more tacky but not firmly solid. Heating the odorless material liberated a menthol odor.

| Elemental analysis showed: | Calc. | found |
|---|---|---|
| % C | 75.74 | 75.90 |
| % H | 11.65 | 11.57 |

Molecular weight, osometric method in acetone, was 1750.

EXAMPLE 12

Polymerization

The carbonate produced in Example 6, fraction 3, was placed (2.0g) with 0.15g of benzoyl peroxide in a 100 ml flask and treated as in Example 2, heating for 112 hours. A colorless, very viscous material was produced. This was dissolved in 40 ml of methylene chloride, and 60 ml of isopropanol was added, then 200 ml of methanol. A white precipitate formed which was tacky and odorless; on standing this lost its tackiness; its weight was 0.4g. A small sample when heated liberated a strong odor of menthol.

NMR spectrum of this product was consistent with a polymer structure; no evidence of unsaturation appeared. Similarly, IR examination showed that the bands indicative of unsaturation at 1642 $cm^{-1}$, 933 $cm^{-1}$, and 903 $cm^{-1}$ were not distinguishable.

| Elemental analysis showed: | Calc. | found |
|---|---|---|
| % C | 73.50 | 73.15 |
| % H | 11.04 | 10.96 |

Molecular weight, osometric method in acetone, was 1730 (ave. degree of polymerization 5.6).

EXAMPLE 13

Polymerization

A heavy-walled glass polymerization vessel was charged with the product of Example 10, 1-menthyl 1,1-dimethylpent-4-enyl carbonate, and with benzoyl peroxide. The vessel was purged of air by the freeze-thaw technique and sealed off under vacuum. In this way, 4.5g of the carbonate was mixed with 300 mg of peroxide. The vessel was maintained at 80° C in an oven for 139.5 hours.

The reaction mixture on removal from the vessel was evaporated to dryness using a rotary evaporator. Methanol (5 ml) dissolved the polymer and the solution was chilled using dry ice. Frozen polymer precipitated and the monomer-rich methanol solution was decanted. The polymer was brought to room temperature and 20 ml of methanol was added and then chilled. This procedure was carried through five cycles and yielded a tacky, transparent, odorless material. After heating to 90° at 1 mm for one hour, polymer weighing 0.75g was retained for testing.

Elemental analysis gave C,H,O values of 72.45, 10.82, and 16.95, the theoretical values being 72.93, 10.88, and 16.19. Infrared analysis showed the material to contain only a small amount of unsaturation. The number average molecular weight as determined from vapor-phase osometry was 1240 corresponding roughly to tetramer. The 0.75g of purified polymer represented a 17% conversion from monomer. However, some polymer was lost during the methanol decantation steps.

What is claimed is:

1. A smoking composition comprising an admixture of a natural or reconstituted tobacco with from about 1 to about 10%, based on the tobacco, of menthol-release agent having the chemical formula:

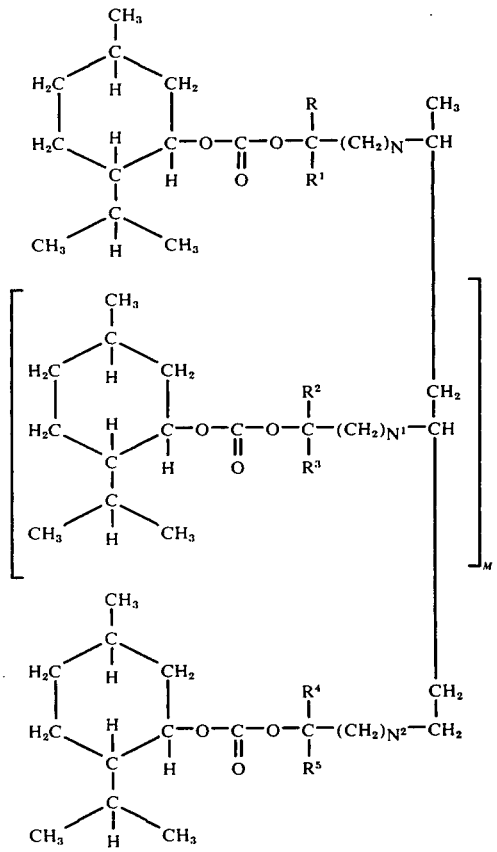

wherein:

N, $N^2$, and each $N^1$ have values of from 0 to 8;

R, $R^1$, $R^4$, $R^5$, and each $R^2$ and $R^3$ are each selected from the group consisting of alkyl having from 1 to 6 carbons, cycloalkyl having from 5 to 10 carbons and aromatic carbocyclic having from 6 to 10 carbons; and M has a value of from 0 to 98.

2. The composition of claim 1, wherein N, $N^2$ and each $N^1$ have values of from 0 to 2.

3. The composition of claim 2, wherein N, $N^2$ and each $N^1$ have values of 0.

4. The composition of claim 1, wherein M has a value of from 4 to 38.

5. The composition of claim 4, wherein N, $N^2$ and each $N^1$ have values of 0.

6. A smoking composition comprising an admixture of a natural or reconstituted tobacco with from about 1 to about 10%, based on the tobacco, of a menthol-release agent having a molecular weight between about 550 and about 30,000 and consisting essentially of polymeric units of the formula:

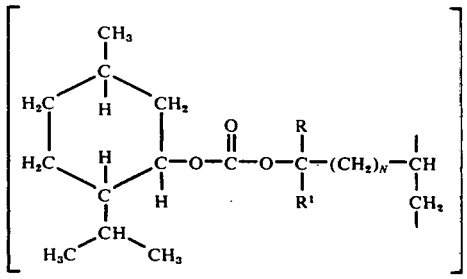

wherein each N has a value of from 0 to 8 and each R and $R^1$ are selected from the group consisting of alkyl having from 1 to 6 carbons, cycloalkyl having from 5 to 10 carbons and aromatic carbocyclic having from 6 to 10 carbons.

7. The composition of claim 6, wherein the molecular weight is between about 1,600 and 12,000.

8. The composition of claim 7, wherein each N has a value of from 0 to 2.

9. The composition of claim 6, wherein the menthol-release agent comprises poly (1-Menthyl 1,1-dimethyl-alkenyl carbonate) having an average molecular weight of from about 550 to about 30,000.

10. The composition of claim 9, wherein the menthol-release agent is a homopolymer of 1-Menthyl 1,1-dimethyl-allyl carbonate having an average molecular weight of from about 1,600 to 12,000.

* * * * *